US005572487A

United States Patent [19]

Tims

[11] Patent Number: 5,572,487

[45] Date of Patent: Nov. 5, 1996

[54] HIGH PRESSURE, HIGH FREQUENCY RECIPROCAL TRANSDUCER

[75] Inventor: James A. Tims, Orlando, Fla.

[73] Assignee: The United States of America as represented by the Secretary of the Navy, Washington, D.C.

[21] Appl. No.: 378,138

[22] Filed: Jan. 24, 1995

[51] Int. Cl.[6] ..... H04R 17/00

[52] U.S. Cl. ..... 367/157; 367/160; 367/162; 310/337; 310/345; 310/356

[58] Field of Search ..... 367/153, 155, 367/163, 174, 157, 158, 160, 162; 310/337, 345, 353, 356, 369

[56] References Cited

U.S. PATENT DOCUMENTS

| | | | |
|---|---|---|---|
| 3,054,982 | 9/1962 | Kieser | 367/157 |
| 3,202,962 | 8/1965 | Elston | 367/160 |
| 3,255,431 | 6/1966 | Howatt | 367/160 |
| 4,010,441 | 3/1977 | Richard | 367/160 |
| 4,694,440 | 9/1987 | Ogura et al. | 367/152 |
| 4,789,971 | 12/1988 | Powers et al. | 367/152 |
| 5,155,707 | 10/1992 | Fisher | 367/149 |

OTHER PUBLICATIONS

Ivey, *A New Standard Reversible Transducer (USRD Type E37) For High Frequency to 2MHz,* Oral Presentation, J. Acous. Soc. of Amer., vol. 94, No. 3, Pt. 2, p. 1831, Sep. 1993.

*Primary Examiner*—J. Woodrow Eldred

*Attorney, Agent, or Firm*—Thomas E. McDonnell; Charles Stockstill

[57] ABSTRACT

A high frequency transducer capable of transmitting and receiving having an operational range from 100 kHz to 2 MHz, a free field voltage sensitivity (FFVS) greater than −218 dB re 1 V/μPa (300 kHz), and a maximum hydrostatic pressure rating of 20.68 Mpa (3000 psi). The sensor element is made of lead titanate with a radial mode of 150 kHz being suppressed by the use of a rubber grommet surrounding the lead titanate element. The sensor element is retained within a sensor housing by a plurality of annealed iron wires attached to an annealed iron ring, both of the faces of the sensor housing are then covered with an acoustically transparent window of natural gum rubber. The sensor housing is attached to a non-metallic preamplifier housing made of a rigid polyurethane containing a preamplifier circuit, a transmit protection circuit, and a plurality of relays for switching the preamplifier circuit during the transmit and receive modes. A remotely control unit is connected to the transducer through a cable attached to a connector located on the preamplifier housing. The sensor housing and preamplifier housing are joined together electrically by a slip fit coaxial coupler for ease of maintenance and repair.

9 Claims, 2 Drawing Sheets

HIGH PRESSURE, HIGH FREQUENCY RECIPROCAL TRANSDUCER

BACKGROUND OF THE INVENTION

1. Field of the invention

This invention pertains generally to an acoustic transducer and in particular to a high pressure, high frequency reciprocal transducer.

2. Description of Related Art

The high frequency transducers currently utilized generally have an operational range from 200 kHz to 1 MHz, a free field voltage sensitivity (FFVS) of −218 dB re 1 V/μPa (300 kHz), and a maximum hydrostatic pressure rating of 351 kPa (51 psi). These devices are limited in that a cork and elastomer composite (CEC) is utilized as a pressure release material and an absorption medium behind and/or around the ceramic elements. While under hydrostatic pressure, the CEC will compress and distort thereby changing the FFVS of the transducer. This change in FFVS renders the currently utilized transducers impractical as a reference standard in applications requiring high hydrostatic pressures. A current need exists within the underwater acoustic field for a butyl high frequency transducer with a higher FFVS than currently found in the art, a flatter response curve, and a capability to operate under a hydrostatic pressure of 20.68 MPa (3000 psi).

SUMMARY OF THE INVENTION

The object of this invention is to provide an acoustic transducer that has a broad bandwidth, is more sensitive than transducers currently in use, and will operate at hydrostatic pressures up to 20.68 MPa (3000 psi).

An objective of this invention is to provide an acoustic transducer that may be utilized as a projector as well as a hydrophone—a reversible transducer.

Another objective of this invention is to provide an acoustic transducer that is easy to calibrate and economical to repair.

These objectives are achieved by a high pressure, high frequency reciprocal transducer utilizing a unique sensor configuration having a lead titanate disc sensor supported by a butyl rubber ring. The faces of the sensor are covered with polyurethane and held in place in a frame assembly by a thin wire. The receiver preamplifier assembly is designed for high frequency operation, with a built-in bypass relay to allow signals to be transmitted as well as received. A cylindrical outer housing allows utilization at high hydrostatic pressures.

DESCRIPTION OF THE RELATED ART

With reference to the drawings, like numerals represent like elements throughout the views.

Figure 1A:
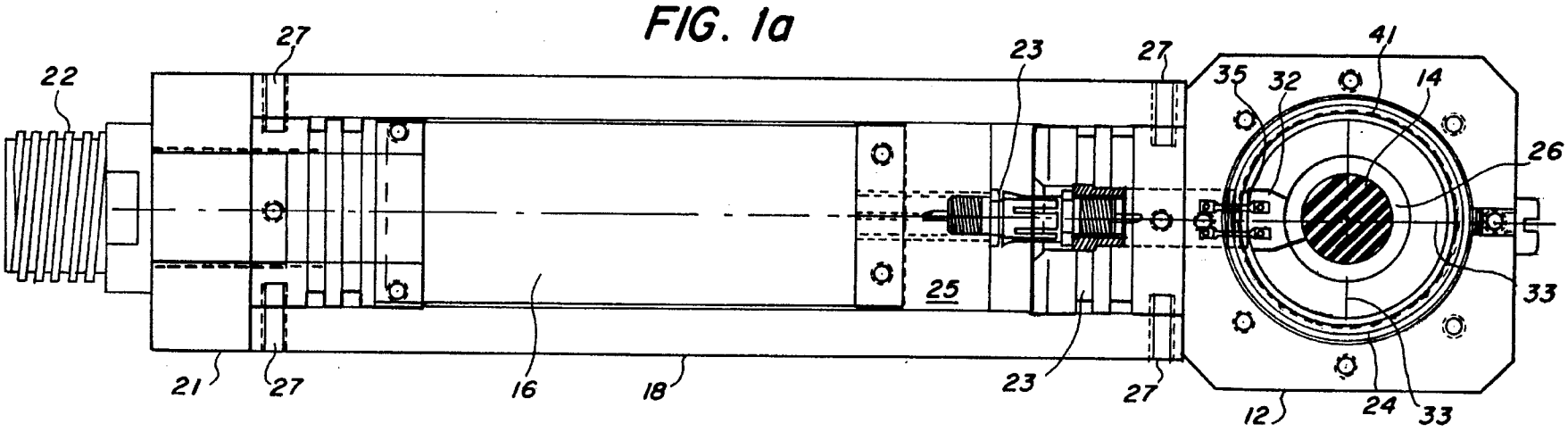
FIG. 1*a* is a schematic cross-sectional view of the transducer assembly.

In the preferred embodiment, the transducer 10, as shown in FIG. 1*a*, is comprised of a sensor head 12 containing a sensor element 14, a preamplifier 16 packaged in a cylindrical non-metallic housing 18, and a high pressure bulkhead connector 22.

The housing 18 is double O-ring sealed (not shown) for redundancy and to ensure sealing at high hydrostatic pressures (3000 psi) and may be made of any non-metallic, acoustically transparent material, a rigid polyurethane is preferable because it is acoustically transparent at high frequencies, however, a 20% glass-filled polycarbonate may also be utilized.

An adapter or end fitting 21, into which the high pressure bulkhead connector 22 is installed, serves to integrate the connector 22, the O-ring seals (not shown), and the preamplifier 16 into an integral unit. The connector 22 may be of any type that will withstand high hydrostatic pressures (3000 psi), such as a model MINL-5-BCRL, manufactured by Brantner & Associates, Inc. of El Cajon, Calif. The insert (not shown) utilized in the connector 22 has a coax connector and four pins. The coax connector (not shown) allows the high frequency output of the transducer 10 to be shielded from electromagnetic cross talk and more closely match the impedance of the cable (not shown). The matched impedance prevents signal loss which is common at high frequencies. The preamplifier 16 is electrically connected to the sensor 14 through a standard plug-in coaxial connector 23 mounted on a phenolic block 25., for structural integrity. Electrical wiring 32 conducts signals from the sensor element 14 through a hermetic seal 35 to the coaxial connector 23. This facilitates the disassembly of the transducer 10 with a minimum of effort, requiring only the disconnection of a plurality of screws.

The wall thickness of the non-metallic housing 18 around the preamplifier 16 allows the transducer 10 to withstand the high hydrostatic pressures to which it may be subjected. The housing 18 is double o-ring (not shown) sealed for redundant leakage protection at 3000 psi.

The preamplifier 16 may be of any known and used in the art. The preamplifier 16, connector 22, and the adapter 21 are assembled separately and mated to the sensor housing 12 which may be replaced in the field when it is determined that a defective preamplifier exists. The preamplifier 16, connector 22 and adapter 21 may then be disassembled and repaired at another location. Utilizing this aspect, repairs can be affected quickly and all major parts can be salvaged.

Figure 1B:
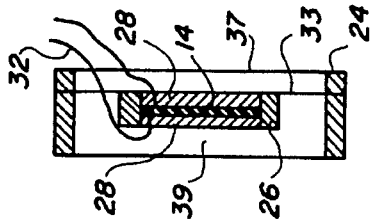
FIG. 1*b* is a schematic of the side view of the sensor assembly.

The sensor element 14, referring now to FIG. 1*b*, used in the transducer 10 is a lead titanate disk. The lead titanate element has a higher free field voltage sensitivity (FFVS) than the elements utilized in the prior art. The disk may be of any size, dependent upon the ultimate size of the transducer 10. The optimum size for the test application was found to be 0.75 inches in diameter and 0.03125 inches thick. This diameter was chosen in the test transducer 10 because it is the same size as the lithium sulfate elements used in the prior art, thereby allowing a comparison of the primary lobe of the beam patterns of the present embodiment with that of the prior art. At 1 MHz the beam width is approximately 3° and as the frequency increases the beam width deceases and the transducer 10 becomes more directional. The thickness was selected to extend the usable frequency range of the transducer 10 up to the thickness mode resonance which is just above 2 MHz. Generally, when an element is smaller than the optimum size, set forth above, the pattern of the beam is increased but the frequency range of the transducer 10 is decreased.

The radial mode of the sensor element 14 is dampened approximately 6 dB by epoxying the element 14 into a rubber grommet 26, preferably butyl rubber, that has an inner diameter slightly smaller than the diameter of the sensor element 14. This sensor element 14 is mounted on annealed iron wire 33 strung in a mounting ring 24 made of the same material as the housing to form a cross in the center of the ring 24. Using the grommet 26 as a mold, both faces of the sensor element 14 are then cast in polyurethane 28 for structural integrity, a technique that is well known to those practicing in the art. In the test transducer 10 calculations based on the length of the wires 33 determined that resonances of the wires 33 were far below the frequency range of the prior art and therefore would not adversely affect the performance of the transducer 10. The mounting ring 24 is designed to slip fit into the head assembly 12 and is held in place by an acoustically transparent window or diaphragm (not shown) and its retaining ring 41.

Both faces of the sensor housing 12 are covered with the acoustically transparent window (not shown), preferably of natural gum rubber. Though normally only found on one face of the sensor housing 12, the addition of the second window (not shown) to the back of the sensor housing 12 allows high pressure operation. The addition of the second window 37 allows the internal pressure in the sensor housing 12 to be equal to the external pressure thereby making the sensor housing 12 "transparent" to the hydrostatic pressure. The space 39 between the windows (not shown) and surrounding the sensor element 14 is filled with an oil, such as castor oil, which is acoustically transparent.

Figure 2:
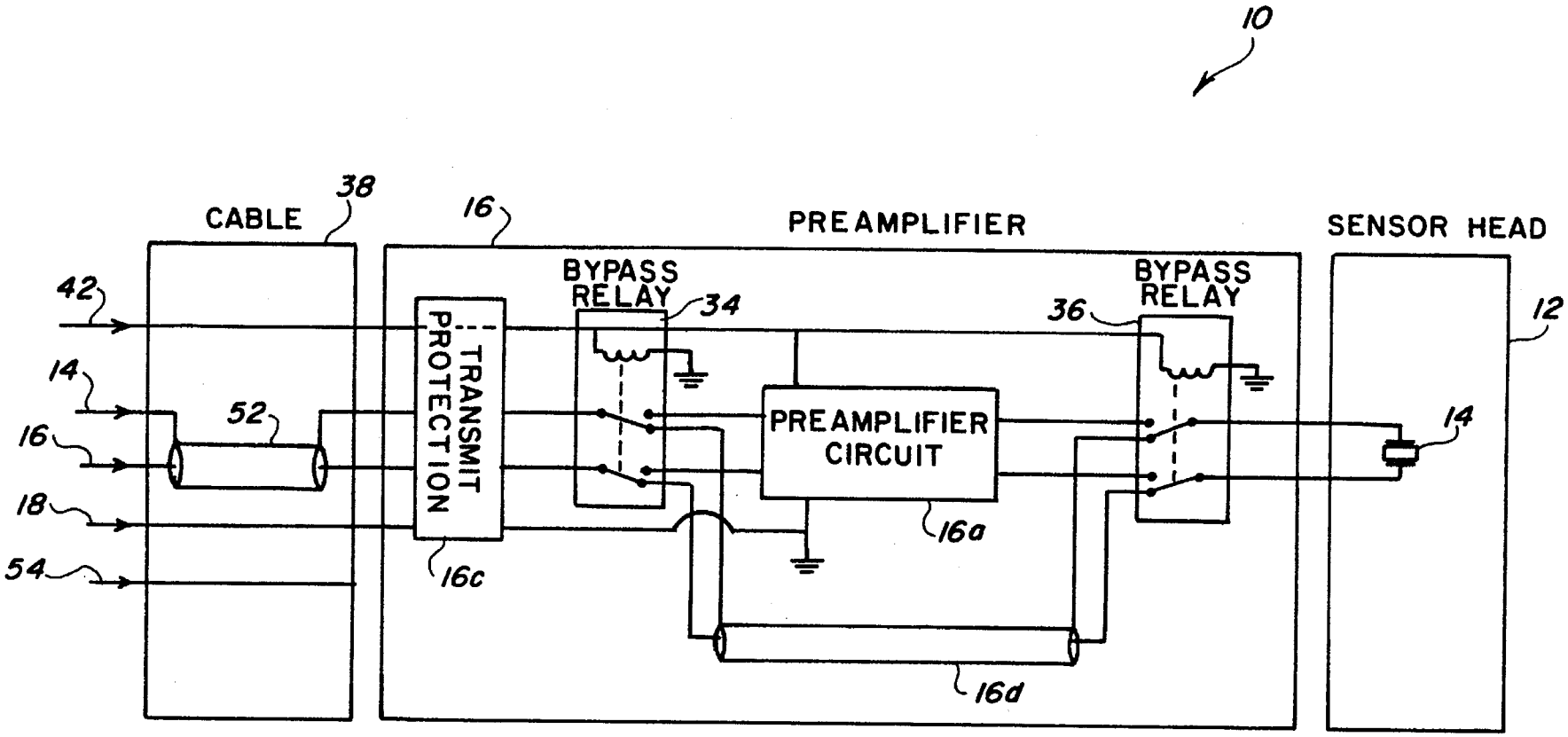
FIG. 2 is a schematic of the preamplifier electronics.

The preamplifier 16 has, referring to FIG. 2, built-in bypass relays 34 and 36 to allow transmitting when the preamplifier circuit **16*a* is turned off. The transmitted signal bypasses the preamplifier circuit 16*a* through a coaxial cable 16*d* to the sensor 14. The transducer 10 can be then be utilized as a projector as well as a hydrophone, therefore it is reversible. A transmission protection device 16C will automatically bypass the preamplifier 16 if a transmit signal is applied while the preamplifier 16** is energized.

Electromagnetic interference shielding (not shown) is provided for the preamplifier 16 by a conetic foil (an optimum thickness being 0.01 in.) wrapped around the periphery of the preamplifier 16 inside of the housing 12. However, shielding may not be necessary in all cases. Power to the transducer 10 is supplied by a cable 38 having as a minimum a coaxial cable 52 for supplying the low and high signals 44 and 46, respectively, when utilized as a transmitter, a shield connection 54; and two wires for supplying a +24 volts direct current (DC) 42 to power the preamplifier 16, transmitter protection **16*c* and bypass relays 34 and 36; and a signal return wire 48. The cable 38 is terminated at the transducer 10** with a mating connector (not shown), such as a model MINL-5-CCP manufactured by Branter & Associates, Inc. of El Cajon, Calif, which is soldered onto the cable, which may be of any type having the minimum required conductors (such as a CO-03 cable manufactured by Boston Insulated Wire of Boston, Mass.) and overmolded in a sealant that is well known to those practicing the art to ensure sealing a high hydrostatic pressures.

The transducer 10 has a frequency range from 100 kHz to 2.0 MHz at hydrostatic pressures to 20.7 MPa (3,000 psi) with operating temperatures from 5° to 35° C. within that frequency range. A smooth response over the broad frequency spectrum has been demonstrated in test devices.

Although the invention has been described in relation to exemplary preferred embodiment thereof, it will be understood by those skilled in this art that still other variations and modifications can be affected in these preferred embodiments without detracting from the scope and spirit of the invention.

What is claimed is:

1. An underwater acoustic transducer comprised of:

means for receiving and transmitting a changing acoustic pressure in a frequency range of 100 kHz to 2 MHz having a first and second face;

means for amplifying an electrical signal;

in a receiving mode, said means for receiving and transmitting a changing acoustic pressure converts the changing acoustic pressure into an electrical signal which is applied to said means for amplifying the electrical signal;

in a transmitting mode a means for applying an input electrical signal directly to said means for receiving or transmitting, said means for receiving or transmitting converting the input electrical signal into an acoustic pressure wave for transmission into an acoustic medium;

a protective housing that is capable of withstanding hydrostatic pressures of at least 3000 psi comprised of a preamplifier section containing said means for amplifying, a sensor housing having a first and second face containing said means for receiving and transmitting, and a means for coupling said means for amplifying to said means for receiving or transmitting; and the sensor housing is further comprised of a grommet surrounding said means for receiving and transmitting for damping the radial mode, acoustically transparent polymer cast on both faces of said means for receiving and transmitting using the grommet as a mold; a mounting ring of rigid polyurethane; a plurality of annealed iron wires attaching the sensing assembly to the mounting ring; an acoustically transparent window on the first and second faces of the sensor housing; and an acoustically transparent oil between the acoustically transparent windows on the first and second faces of the sensor housing surrounding the sensor element.

2. An underwater acoustic transducer comprised of:

means for receiving and transmitting a changing acoustic pressure in a frequency range of 100 kHz to 2 MHz having a first and second face;

means for amplifying an electrical signal;

in a receiving mode, said means for receiving and transmitting a changing acoustic pressure converts the changing acoustic pressure into an electrical signal which is applied to said means for amplifying the electrical signal;

in a transmitting mode, a means for applying an input electrical signal directly to said means for receiving and transmitting, said means for receiving and transmitting converting the input electrical signal into an acoustic pressure wave for transmission into an acoustic medium;

a protective housing that is capable of withstanding hydrostatic pressures of at least 3000 psi comprised of a preamplifier section containing said means for amplifying, a sensor housing having a first and second face containing said means for receiving and transmitting, and a means for coupling said means for amplifying to said means for receiving and transmitting; and the sensor housing is further comprised of a grommet surrounding said means for receiving and transmitting for damping the radial mode, acoustically transparent polymer cast on both faces of said means for receiving and transmitting using the grommet as a mold; a mounting ring of rigid polyurethane; a plurality of annealed iron wires attaching the sensing assembly to the mounting ring; a natural gum rubber forming an acoustically transparent window on the first and second faces of the sensor housing; and an acoustically transparent oil between the acoustically transparent windows on the first and second faces of the sensor housing surrounding the sensor element.

3. A transducer, as in claim 2, wherein the protective housing is a rigid polyurethane.

4. An underwater acoustic transducer comprised of:

means for receiving and transmitting changing acoustic pressure in a frequency range of 100 kHz to 2 MHz having a first and second face;

means for amplifying an electrical signal;

in a receiving mode, said means for receiving and transmitting a changing acoustic pressure converts the changing acoustic pressure into an electrical signal which is applied to said means for amplifying the electrical signal;

in a transmitting mode, means for applying an input electrical signal directly to said means for receiving and transmitting, said means for receiving and transmitting converting the input electrical signal into an acoustic pressure wave for transmission into an acoustic medium;

a protective housing that is capable of withstanding hydrostatic pressures of at least 3000 psi comprised of a preamplifier section containing said means for amplifying, a sensor housing having a first and second face containing said means for receiving and transmitting, and a means for coupling said means for amplifying to said means for receiving and transmitting; and the sensor housing is further comprised of a butyl rubber grommet surrounding said means for receiving and transmitting for damping the radial mode, acoustically transparent polymer cast on both faces of said means for receiving and transmitting using the grommet as a mold, a mounting ring of rigid polyurethane; a plurality of annealed iron wires attaching the sensing assembly to the mounting ring; an acoustically transparent window on the first and second faces of the sensor housing; and an acoustically transparent oil between the acoustically transparent windows on the first and second faces of the sensor housing surrounding the sensor element.

5. An acoustic transducer comprising:

a piezo-electric element, said piezo-electric element comprising a lead titanate disc; and a flexible grommet, said grommet disposed about the outer periphery of said disc effective to dampen the radial mode resonance of said disc.

6. The transducer of claim 5 wherein:

said disc is of a diameter selected to cause said radial mode resonance of said disc to be less than about 200 KHz.

7. The transducer of claim 5 wherein said diameter of said disc is about 0.75 inch.

8. The transducer of claim 5 wherein said grommet is of butyl rubber.

9. The transducer of claim 6 wherein said diameter of said disc is about 0.75 inch.

* * * * *